US007791578B2

(12) United States Patent
Yi

(10) Patent No.: US 7,791,578 B2
(45) Date of Patent: Sep. 7, 2010

(54) CIRCUIT FOR DRIVING COMMON VOLTAGE OF IN-PLANE SWITCHING MODE LIQUID CRYSTAL DISPLAY DEVICE

(75) Inventor: Sang Yeol Yi, Kyonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1014 days.

(21) Appl. No.: 11/017,101

(22) Filed: Dec. 21, 2004

(65) Prior Publication Data

US 2005/0140637 A1 Jun. 30, 2005

(30) Foreign Application Priority Data

Dec. 30, 2003 (KR) ..... 10-2003-0100996

(51) Int. Cl.
*G09G 3/36* (2006.01)

(52) U.S. Cl. ..... 345/96

(58) Field of Classification Search ..... 345/87–107, 345/204, 208, 209, 54; 714/726
See application file for complete search history.

(56) References Cited

U.S. PATENT DOCUMENTS 5,831,605 A * 11/1998 Yasui et al. ..... 345/204
6,456,268 B1 * 9/2002 Takeda ..... 345/204
6,492,970 B1 * 12/2002 Furuhashi et al. ..... 345/96
2002/0018059 A1 * 2/2002 Yanagi et al. ..... 345/204
2003/0145263 A1 * 7/2003 Song et al. ..... 714/726
2004/0041773 A1 * 3/2004 Takeda et al. ..... 345/98

FOREIGN PATENT DOCUMENTS

JP 9-243992 9/1997
JP 11-194320 7/1999
JP 11-282431 10/1999

* cited by examiner

*Primary Examiner*—Chanh Nguyen
*Assistant Examiner*—Adam J Snyder
(74) *Attorney, Agent, or Firm*—Morgan, Lewis & Bockius LLP

(57) ABSTRACT

A common voltage driving circuit of an in-plane switching (IPS) mode liquid crystal display (LCD) device includes a first common voltage output part for swinging and outputting positive (+) and negative (−) common voltages on odd numbered common lines, a second common voltage output part for swinging and outputting negative (−) and positive (+) common voltages on even numbered common lines, an intermediate level output part for outputting an intermediate level voltage between the positive (+) and negative (−) common voltages output from the first and second common voltage output parts, a first switching part for selecting one out of the voltages output from the first common voltage output part and the intermediate level output part, and outputting the selected one, and a second switching part for selecting one out of the voltages output from the second common voltage output part and the intermediate level output part, and outputting the selected one.

2 Claims, 13 Drawing Sheets

Realted Art

CIRCUIT FOR DRIVING COMMON VOLTAGE OF IN-PLANE SWITCHING MODE LIQUID CRYSTAL DISPLAY DEVICE

The present invention claims the benefit of the Korean Application No. P2003-100996, filed on Dec. 30, 2003, which is hereby incorporated by reference.

BACKGROUND OF THE INVENTION

1. Field of the Invention

The present invention relates to a driving circuit of an in-plane switching (IPS) mode liquid crystal display (LCD) device, and more particularly, to a common voltage driving circuit of an IPS mode LCD device.

2. Discussion of the Related Art

A liquid crystal display (LCD) device changes optical anisotropy as a result of an electric field applied to liquid crystal having both the fluidity of liquid and the optical characteristics of crystal. Recently, the LCD device has been widely utilized because of its advantageous characteristics, such as low power consumption, thin profile, high resolution, and low size to weight ratio, as compared with a conventional cathode ray tube (CRT).

The LCD device includes an LCD panel for displaying images, and a driving circuit part for supplying driving signals to the LCD panel. Also, the LCD panel includes first and second substrates bonded to each other with a predetermined gap therebetween. A liquid crystal layer is injected between the first and second substrates.

The first substrate, known as a thin film transistor array substrate, includes a plurality of gate lines arranged in a first direction at fixed intervals, a plurality of data lines arranged in a second direction perpendicular to the gate lines at fixed intervals, a plurality of pixel electrodes in respective pixel regions arranged in a matrix-type configuration, and a plurality of thin film transistors (TFTs) for switching in response to a signal on the gate line for transmission of a signal on the data line to the pixel electrode. The second substrate, known as a color filter array substrate, includes a black matrix layer for shielding light from areas other than the pixel regions, an R/G/B color filter layer for displaying various colors, and a common electrode for implementing the images. In addition, the predetermined gap is maintained between the first and second substrates by spacers. The first and second substrates are bonded to each other by a sealant having an injection inlet, through which the liquid crystal material is injected between the first and second substrates.

FIG. 1 illustrates a block diagram of a driving circuit part in an LCD device according to the related art. As shown in FIG. 1, the related art LCD device includes an LCD panel 1, a driving circuit part 2, and a backlight 8. The LCD panel 1 is formed with pixel regions in a matrix-type configuration with gate lines G and data lines D arranged perpendicular with respect to each other. The driving circuit part 2 supplies driving signals and data signals to the LCD panel 1. The backlight 8 supplies constant light to the LCD panel 1.

The driving circuit part 2 includes a data driver 1*b*, a gate driver 1*a*, a timing controller 3, a power supply part 4, a gamma reference voltage part 5, a DC/DC converter 6, and an inverter 9. The data driver 1*b* inputs a data signal to each data line D of the LCD panel 1. The gate driver 1*a* supplies a gate driving pulse to each gate line G of the LCD panel 1. The timing controller 3 receives display data R/G/B, vertical and horizontal synchronous signals Vsync and Hsync, a clock signal DCLK and a control signal DTEN from a driving system 7, and formats and outputs the display data, the clock signal DCLK and the control signal DTEN at a timing suitable for restoring a picture image by the gate driver 1*a* and the data driver 1*b* of the LCD panel 1. The power supply part 4 supplies voltages to the LCD panel 1 and other components. The gamma reference voltage part 5 receives a voltage from the power supply part 4 to provide a reference voltage required when digital data from the data driver 1*b* is converted to analog data. The DC/DC converter 6 outputs a constant voltage $V_{DD}$, a gate high voltage (gate turn-on voltage) $V_{GH}$, a gate low voltage (gate turn-off voltage) $V_{GL}$, a gamma reference voltage $V_{ref}$, and a common voltage $V_{com}$ for the LCD panel 1 by using a voltage output from the power supply part 4. The inverter 9 serves to drives the backlight 8. Control signals supplied to the gate driver 1*a* from the timing controller 3 are GSC (Gate Shift Clock), GSP (Gate Shift Pulse) and GOE (Gate Output Enable), and control signals supplied to the data driver 1*b* from the timing controller 3 are SSC (Source Shift Clock), SSP (Source Shift Pulse), SOE (Source Output Enable), POL (Polarity signal) and REV (Reverse signal).

An operation of the driving circuit part 2 of the related art LCD device is described as follows. As mentioned above, the timing controller 3 receives the display data R/G/B, the vertical and horizontal synchronous signals Vsync and Hsync, the clock signal DCLK, and the control signal DTEN from the driving system (PC) 7, and provides the display data, the clock signal DCLK and the control signal DTEN at the timing suitable for restoring the picture image to the gate driver 1*a* and the data driver 1*b* of the LCD panel 1. The gate driver 1*a* supplies the gate driving pulse to each gate line G of the LCD panel 1, and the data driver 1*b* synchronously inputs the data signal to each data line D of the LCD panel 1, thereby displaying the input video signal.

The LCD device has various modes according to the properties of liquid crystal and pattern structure. Specifically, LCD devices are categorized into a twisted nematic (TN) mode for controlling liquid crystal director by applying a voltage after arrangement of liquid crystal director twisted at 90°, a multi-domain mode for obtaining a wide viewing angle by dividing one pixel into several domains, an optically compensated birefringence (OCB) mode for compensating a phase change of light according to progressing direction of light by forming a compensation film on an outer surface of a substrate, an in-plane switching (IPS) mode for forming an electric field parallel to two substrates by forming two electrodes on any one substrate, and a vertical alignment (VA) mode for arranging a longitudinal (major) axis of liquid crystal molecule vertical to a plane of an alignment layer by using negative type liquid crystal and vertical alignment layer. Among them, the IPS mode LCD device generally includes a color filter substrate and a thin film transistor array substrate facing each other, and a liquid crystal layer formed between the two substrates. The color filter substrate of the IPS mode LCD device includes a black matrix layer for preventing light leakage, and an R/G/B color filter layer for realizing various colors on the black matrix layer. The thin film transistor array substrate of the IPS mode LCD device includes gate and data lines to define a unit pixel region, a switching device formed at a crossing point of the gate and data lines, and common and pixel electrodes alternately for generating an electric field across the liquid crystal.

A description of a related art IPS mode LCD device and a method for fabricating the will be made in reference to the accompanying drawings. FIG. 2 illustrates a plane view of a unit pixel in the related art IPS mode LCD device. FIG. 3 illustrates a voltage distribution of the IPS mode LCD device along line I-I' of FIG. 2. FIG. 4A and FIG. 4B illustrate plane views of the IPS mode LCD device when a voltage is turned on/off.

FIG. 2 shows a part of a thin film transistor array substrate of the related art IPS mode LCD device. The thin film transistor array substrate includes a gate line 12, a data line 15, a thin film transistor TFT, a common line 25, a plurality of common electrodes 24, a plurality of pixel electrodes 17, and a capacitor electrode 26. Herein, the gate line 12 is formed in one direction on the thin film transistor array substrate, and the data line 15 is formed perpendicular to the gate line 12 to define a pixel region. The thin film transistor TFT is formed adjacent to a crossing portion of the gate and data lines 12 and 15. The common line 25 is then formed in parallel with the gate line 12 within the pixel region. The plurality of common electrodes 24 diverge from the common line 25 and are formed in parallel with the data line 15. The plurality of pixel electrodes 17 are connected with a drain electrode of the thin film transistor TFT. Each of the pixel electrodes 17 is provided between the common electrodes 24 in parallel. The capacitor electrode 26 extends from the pixel electrode 17 and overlaps with the common line 25.

The thin film transistor TFT is comprised of a gate electrode 12*a* diverging from the gate line 12, a gate insulating layer (not shown) formed over an entire surface of the thin film transistor array substrate, a semiconductor layer 14 formed over the gate insulating layer, and source and drain electrodes 15*a* and 15*b* at both sides of the semiconductor layer 14. The common line 25 is integrally formed with the common electrode 24. The gate line 12 is integrally formed with the gate electrode. Also, the common line 25 and the gate line 12 are simultaneously formed of a low-resistance metal material. Any of the common electrodes 24 may be overlapped with the data line to function as a black matrix, thereby improving an aperture ratio.

The pixel electrodes 17 are formed of a transparent conductive metal material having great transmittance, for example, indium-tin-oxide (ITO), wherein each of the pixel electrodes 17 alternates with each of the common electrodes 24. Also, the pixel electrode 17 is in contact with the drain electrode of the thin film transistor TFT. The capacitor electrode 26 is integrally formed with the pixel electrode 17 to create a storage capacitor.

In the related art IPS mode LCD device, as shown in FIG. 3, if a voltage of 5V is applied to the common electrode 24 and a voltage of 0V is applied to the pixel electrode 17, an equipotential surface is formed in parallel to the two electrodes at the portions right above the two electrodes but is formed in perpendicular to the two electrodes at the portion between the two electrodes. Accordingly, since an electric field is perpendicular to the equipotential surface, a horizontal electric field is formed between the common electrode 24 and the pixel electrode 17, a vertical electric field is formed on the respective electrodes 24 and 17, and both the horizontal and vertical electric fields are formed in the edge of the electrodes 24 and 17.

Alignment of liquid crystal molecules in the related art IPS mode LCD device is controlled with the electric field. For example, as shown in FIG. 4B, if a sufficient voltage is applied to liquid crystal molecules 31 initially aligned in the same direction as a transmission axis of one polarizing sheet, long axes of the liquid crystal molecules 31 are re-aligned to be in parallel to the electric field. When the dielectric anisotropy of the liquid crystal is negative, short axes of the liquid crystal molecules 31 are re-aligned to be in parallel to the electric field. Specifically, first and second polarizing sheets are formed on outer surfaces of the thin film transistor array substrate and the color filter substrate, and the transmission axes of the first and second polarizing sheets are perpendicular to each other, so as to normally display a black mode. If the voltage is not provided to the LCD panel, as shown in FIG. 4A, the liquid crystal molecules 31 are aligned to display the black state. On the other hand, as shown in FIG. 4B, if the voltage is provided to the LCD panel, the liquid crystal molecules 31 are re-aligned to be in parallel to the electric field, thereby displaying the white state.

The liquid crystal material injected between the first and second substrates may deteriorate when a DC voltage is applied for a long time. In order to prevent such a problem, a polarity of the supplied voltage is cyclically changed, which is commonly referred to as a polarity inversion method. The polarity inversion methods include a frame inversion method, a line inversion method, a column inversion method, and a dot inversion method. The dot inversion method is applied to high-resolution devices (i.e., XGA, SXGA, and UXGA) for obtaining a picture image with high quality. In the dot inversion method, a polarity of a data voltage is differently supplied to all-direction adjacent pixels, and therefore it is possible to minimize flicker by spatial averaging. However, the dot inversion method has been problematic since the dot inversion method has a high consumption because of the use of a high-voltage source driver.

A related art IPS mode LCD device of the dot inversion method is described in reference to FIGS. 5 and 6. FIG. 5 illustrates an equivalent circuit view of the related art IPS mode LCD device. FIG. 6 illustrates a timing view of a pixel voltage in each gate line of FIG. 5. As shown in FIG. 5, in a unit pixel of the related art IPS mode LCD device, a thin film transistor TFT is formed adjacent to at each crossing of gate lines (G1, G2, G3, . . . ) and data lines (D1, D2, D3, . . . ). Also, a storage capacitor $C_{st}$ and a liquid crystal capacitor $C_{LC}$ connected with a drain electrode in each thin film transistor and a common line (Vcom1, Vcom2, Vcom3, . . . ) are formed in parallel between a pixel electrode ('17' of FIG. 2).

As shown in FIG. 6, the common voltage Vcom is maintained at a DC voltage having a constant level, even though the signal voltage of the pixel or the gate line is changed or the frame is changed. In this state, the common voltage Vcom is at the intermediate level between two level voltages applied to the data lines. The polarity of the voltage applied to the data line is inversely applied to the respective pixels in each horizontal period. That is, the data voltage is applied such that positive (+) and negative (−) polarities for the Vcom are inversely applied to the respective pixels by alternately applying the positive (+) and negative (−) polarity data voltages to the data lines. At this time, the same polarity of the data voltage is applied to respective odd data lines or respective even data lines.

By applying the gate pulse to the gate line, the thin film transistor of the corresponding line is turned-on. Thus, the video signal applied to each data line through the turned-on thin film transistor is supplied to each pixel. Then, the liquid crystal capacitor $C_{LC}$ and the storage capacitor Cst connected between the drain electrode of the thin film transistor and the common line are charged during a period of the thin film transistor being turned-on. After the thin film transistor is turned-off, electric charges are maintained until the thin film transistor is turned-on.

Referring to FIG. 6, a pixel voltage is changed by a difference amount ΔVp according to a parasitic capacitor Cgs formed between the gate and source electrodes of the thin film transistor along a falling edge of the scanning signal supplied to the gate line, whereby an alignment direction of the liquid crystal material is induced by the difference amount ΔVp.

However, when the related art IPS mode LCD device of the dot inversion method is driven, a constant value is supplied to the common voltage signal in the D.C. state, and the positive (+) and negative (−) polarity data voltages for the common voltage signal are alternately supplied to the data lines of the respective pixels. Accordingly, the pixel voltage Vp supplied to the liquid crystal has the polarity dependent on the data voltage, so that it is required to use a source driver having a great output voltage difference to induce a high voltage to the liquid crystal material.

In the related art IPS mode LCD device, the liquid crystal is driven according to a fringe field formed between the pixel electrode and the common electrode. Accordingly, it is required to form the fringe field having a great value by narrowing an interval between the pixel electrode and the common electrode. To narrow the interval between the pixel electrode and the common electrode, it is necessary to pattern the pixel and common electrodes in a finger type crossed at a predetermined interval when the pixel and common electrodes are patterned. However, if the interval between the pixel electrode and the common electrode becomes narrow, an aperture ratio of the pixel is degraded. To improve the aperture ratio, the pixel or common electrode may be formed of a transparent material, such as ITO (Indium-Tin-Oxide). However, since patterns having various shapes are formed within the pixel region, it is difficult to uniformly transmit the light. When the interval between the pixel electrode and the common electrode for improving the aperture ratio is widened, the electric field parallel to the substrates decreases between the pixel electrode and the common electrode. Thus, a high output range of the data voltage must be extended to obtain a required luminance.

Recently, an IPS mode LCD device and a method for driving the same have been proposed to obtain a high liquid crystal voltage between the common electrode and the pixel electrode without using a high output source driver and to improve picture quality with swing of the common voltage by supplying the data voltage and the common voltage of the opposite polarity to the odd/even numbered common lines for the increase of electrode interval and the decrease of driving voltage. FIG. 7 illustrates an equivalent circuit view of a related art IPS mode LCD device for increasing the electrode interval and decreasing the driving voltage. FIG. 8 illustrates a timing view of a pixel voltage in each gate line of FIG. 7.

As shown in FIG. 7, a plurality of gate lines (G1, G2, G3, G4, . . . ) are perpendicular to a plurality of data lines (D1, D2, D3, D4, . . . ). Also, each common line (Vcom1, Vcom2, Vcom3, . . . ) is formed between the gate lines, and a thin film transistor TFT is formed adjacent to a crossing of the gate and data lines. Further, a first storage capacitor $C_{st}$ and a first liquid crystal capacitor $C_{LC}$ connected with a drain electrode of the thin film transistor are formed in parallel, between the common line and a pixel electrode ('17' of FIG. 2).

For the increase of the electrode interval and the decrease of the driving voltage in the related art IPS mode LCD device, when a first common voltage (or second common voltage) is applied to the odd numbered common line (Vcom1, Vcom3, . . . ), a second common voltage (or first common voltage) is applied to the even numbered common line (Vcom2, Vcom4, . . . ). In this state, the data voltage of the same polarity is applied to the pixels connected with the same common line. That is, as shown in FIG. 8, if the data voltage of positive (+) polarity is applied to a predetermined pixel, the first common voltage (Vcom(−)) is applied to the corresponding common line. On the other hand, if the data voltage of negative (−) polarity is applied to a predetermined pixel, the second common voltage (Vcom(+)) is applied to the corresponding common line. Accordingly, a voltage difference increases between the pixel electrode and the common electrode. This related art IPS mode LCD device has a common voltage driving circuit to divide the common lines into odd numbered common lines and even numbered common lines and to apply the common voltage to the odd/even numbered common lines separately.

FIG. 9 illustrates a circuit diagram of the common voltage driving circuit by a common voltage swing method according to the related art. FIG. 10 illustrates a timing view of an output waveform of FIG. 9. As shown in FIG. 9, the related art common voltage driving circuit includes a first common voltage output part 50 for swing and outputting the common voltage of positive (+) and negative (−) polarity to the odd numbered common lines, and a second common voltage output part 60 for swing and outputting the common voltage of positive (+) and negative (−) polarity to the even numbered common lines. Herein, the first and second common voltage output parts 50 and 60 respectively include first and second dividers 51 and 61, first and second inversion amplifiers 52 and 62, and first and second push/pull amplifiers 53 and 63. The first divider 51 comprising resistance Ru1 and Rv and the second divider 61 comprising resistance Ru2 divide a constant voltage $V_{LCD}$. The first and second inversion amplifiers 52 and 62 amplify and output respective voltages output from the first and second dividers 51 and 61 according to first and second control signals CNT1 and CNT2 output from a timing controller ('3' of FIG. 1). Then, the first and second push/pull amplifiers 53 and 63 re-amplify the respective voltages output from the first and second inversion amplifiers 52 and 62, and output the re-amplified voltages to the odd numbered common lines and the even numbered common lines.

Next, an output of the related art common voltage driving circuit is described with reference to FIG. 10. As shown in FIG. 10, the first and second control signals CNT1 and CNT2 having the opposite phases are output from the timing controller. Thus, the first common voltage output part 50 and the second common voltage output part 60 swing the common voltages to have the opposite polarity by using the first and second inversion amplifiers 52 and 62 and the first and second push/pull amplifiers 53 and 63. That is, the first and second inversion amplifiers 52 and 62 compare the respective voltages divided by the first and second dividers 51 and 61 with the first and second control signals CNT1 and CNT2 output from the timing controller, and then amplify and output the respective voltages. The first and second push/pull amplifiers 53 and 63 amplify the voltages output from the first and second inversion amplifiers 52 and 62 to signals having great linearization and less distortion, and then output the amplified voltages.

The related art common voltage driving circuit has the following disadvantages. The related art common voltage driving circuit swings the common voltages with the inversion amplifier, whereby an A.C. consumption voltage ($P_{AC}$) of the IPS mode LCD device is obtained as follows, $$P_{AC}=n\times C\times f\times(V_{CH}-V_{CL})^2,$$

wherein, 'n' is the number of common voltages swung, 'C' is a capacitor load of the common voltage, a total amount of a storage capacitor amount and a parasitic capacitor amount between the common line and the data line, 'f' is a frequency of the common voltage, and ($V_{CH}-V_{CL}$) is a swing width of the common voltage. Accordingly, the common voltage swing driving circuit of the related art IPS mode LCD device utilizes the inversion amplifier, so that the common voltages are repetitively swung between the highest value ((+) common voltage) and the lowest value ((−) common voltage), thereby increasing the power consumption.

SUMMARY OF THE INVENTION

Accordingly, the present invention is directed to a common voltage driving circuit of an IPS mode LCD device that substantially obviates one or more problems due to limitations and disadvantages of the related art.

An object of the present invention is to provide a common voltage driving circuit of an IPS mode LCD device using a common voltage swing method, to decrease A.C. power consumption.

Additional advantages, objects, and features of the invention will be set forth in part in the description which follows, and in part will become apparent from the description, or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the common voltage driving circuit of an IPS mode LCD device includes a first common voltage output part for swing and outputting positive (+) and negative (−) common voltages on odd numbered common lines; a second common voltage output part for swing and outputting negative (−) and positive (+) common voltages on even numbered common lines; an intermediate level output part for outputting a voltage of an intermediate level between the positive (+) and negative (−) common voltages output from the first and second common voltage output parts; a first switching part for selecting one out of the voltages output from the first common voltage output part and the intermediate level output part, and then outputting the selected one; and a second switching part for selecting one out of the voltages output from the second common voltage output part and the intermediate level output part, and then outputting the selected one.

In another aspect, a method for driving a common voltage in an IPS mode LCD device includes swinging and outputting positive (+) and negative (−) common voltages on odd numbered common lines, swinging and outputting negative (−) and positive (+) common voltages on even numbered common lines, outputting an intermediate level voltage between the positive (+) and negative (−) common voltages output from the first and second common voltage output parts, selecting one out of the voltage output to the odd numbered common lines and the intermediate level voltage, and outputting the selected one, and selecting one out of the voltage output to the even numbered common lines and the intermediate level voltage, and outputting the selected one.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 11:
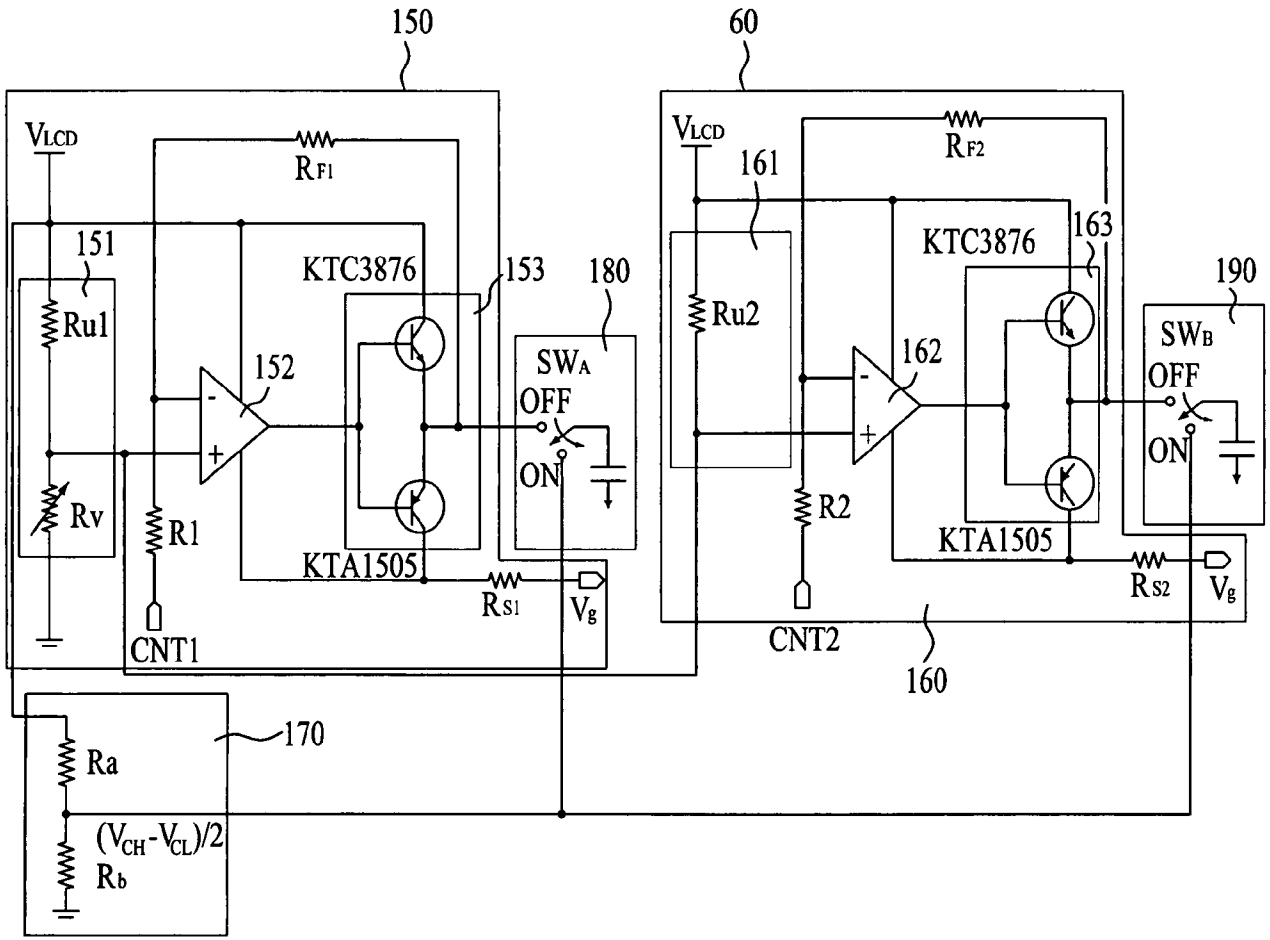
FIG. 11 illustrates a circuit diagram of a common voltage driving circuit of an IPS mode LCD device according to an embodiment of the present invention.
Figure 12:
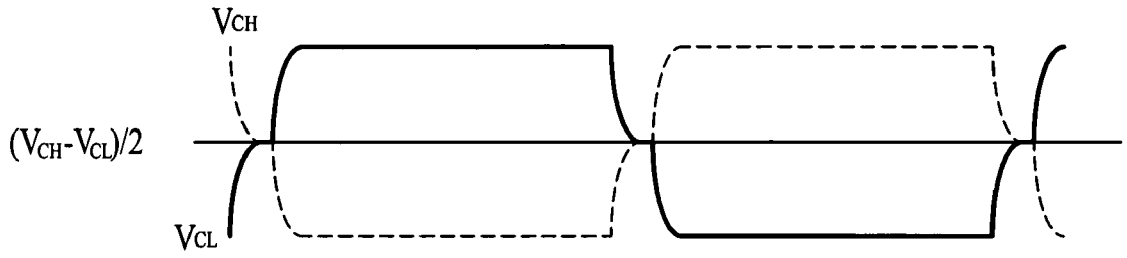
FIG. 12 illustrates a timing view of an output waveform of FIG. 11.

A common voltage driving circuit of an IPS mode LCD device according to an exemplary embodiment of the present invention will be described with reference to the accompanying drawings. FIG. 11 illustrates a circuit diagram of a common voltage driving circuit of an IPS mode LCD device according to this embodiment. FIG. 12 illustrates a timing view of an output waveform of FIG. 11.

As shown in FIG. 11, the common voltage driving circuit includes a first common voltage output part 150, a second common voltage output part 160, an intermediate level output part 170, a first switching part 180, and a second switching part 190. Herein, the first common voltage output part 150 swings and outputs positive (+) and negative (−) common voltages on odd numbered common lines. The second common voltage output part 160 swings and outputs negative (−) and positive (+) common voltages on even numbered common lines. The intermediate level output part 170 divides a constant voltage Vcc to output a voltage of an intermediate level between the positive (+) and negative (−) common voltages output from the first and second common voltage output parts 150 and 160. The first switching part 180 selects one out of the voltages output from the first common voltage output part 150 and the intermediate level output part 170, and then outputs the selected one. The second switching part 190 selects one out of the voltages output from the second common voltage output part 160 and the intermediate level output part 170, and then outputs the selected one.

Figure 1:
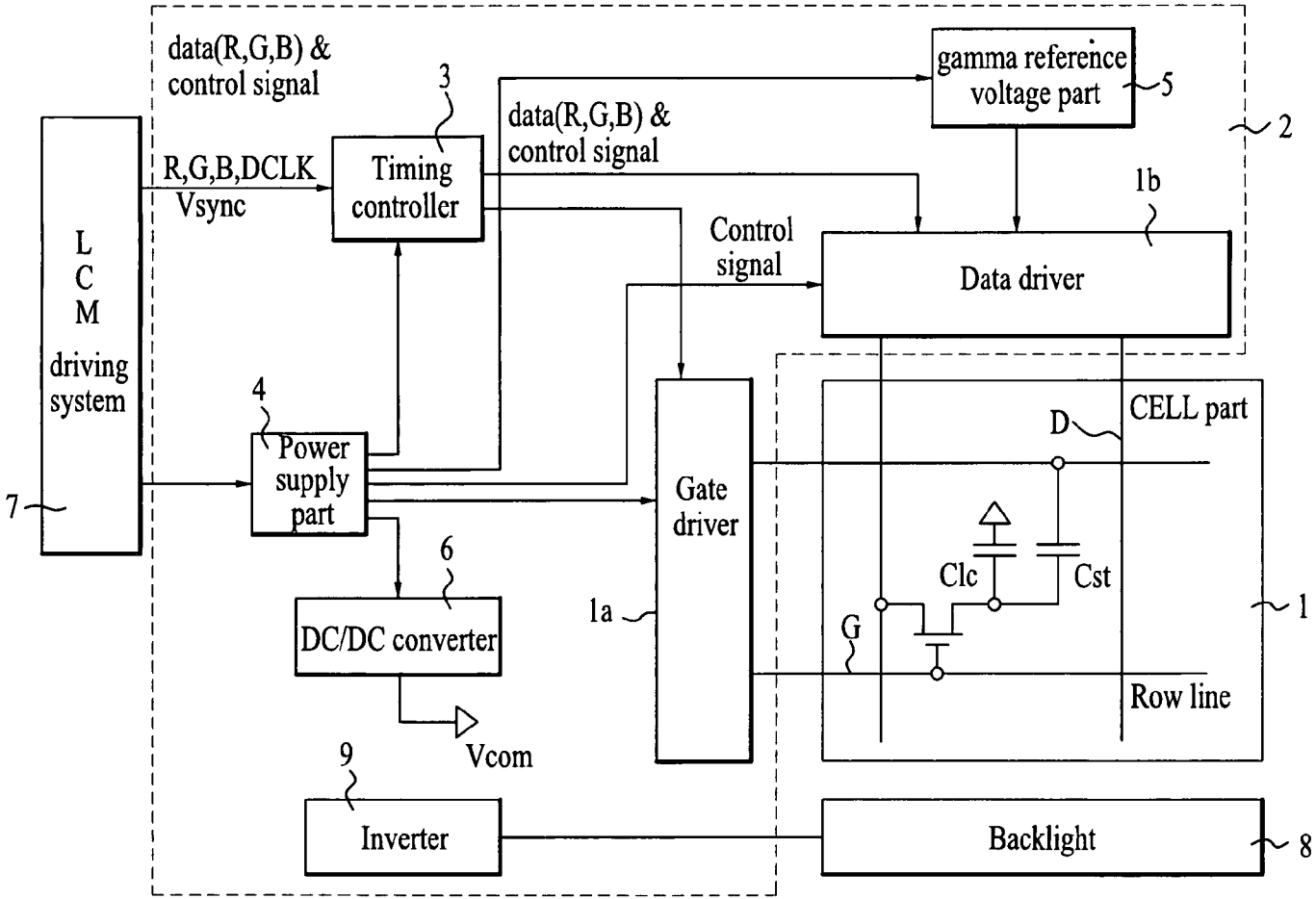
FIG. 1 Related Art
FIG. 1 illustrates a block diagram of a driving circuit part in an LCD device according to the related art.
Figure 2:
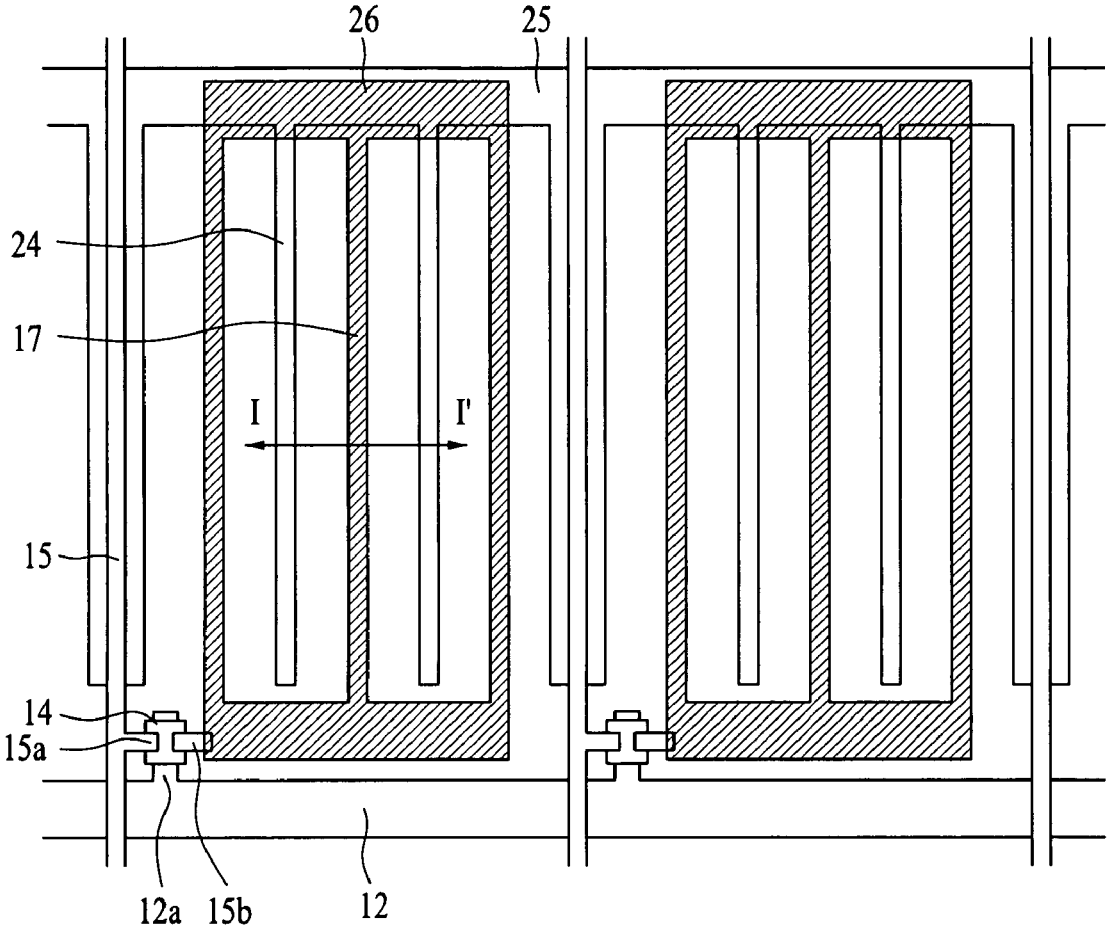
FIG. 2 Related Art
FIG. 2 illustrates a plane view of a unit pixel in the related art IPS mode LCD device of FIG. 2.
Figure 3:
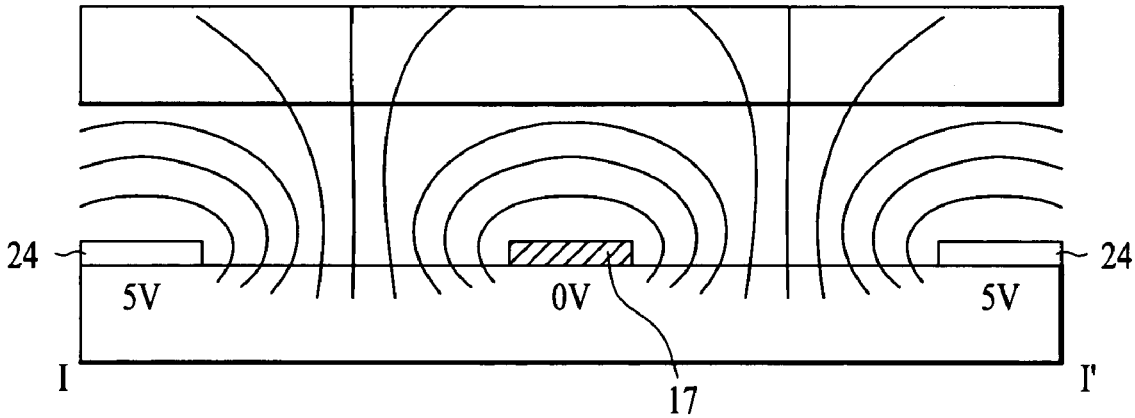
FIG. 3 illustrates a voltage distribution of the related art IPS mode LCD device along line I-I' of FIG. 2.
Figure 4A:
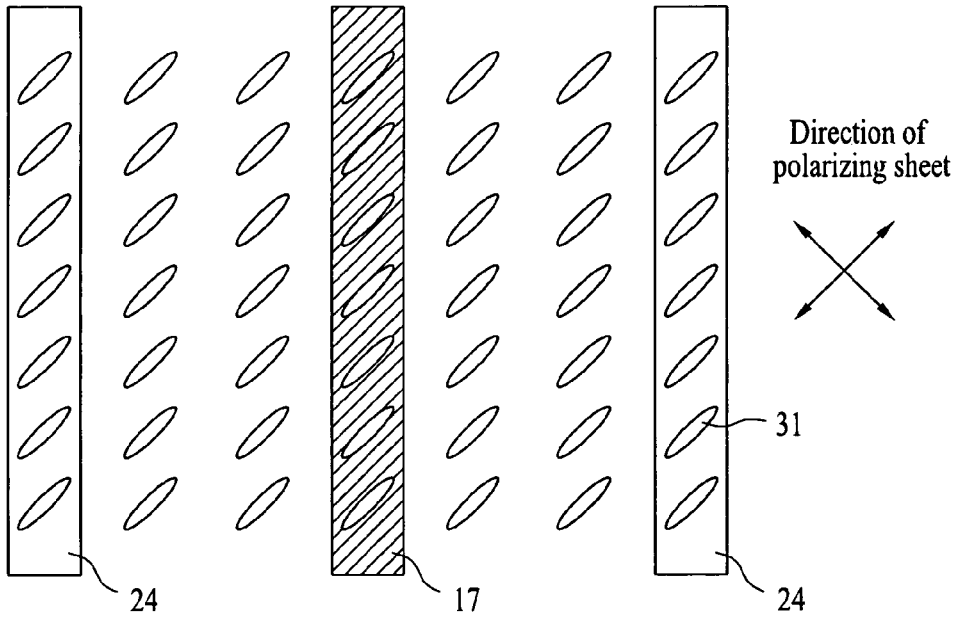
FIG. 4A Related Art
FIG. 4A and FIG. 4B illustrate plane views of the related art IPS mode LCD device when a voltage is turned on/off.
Figure 4B:
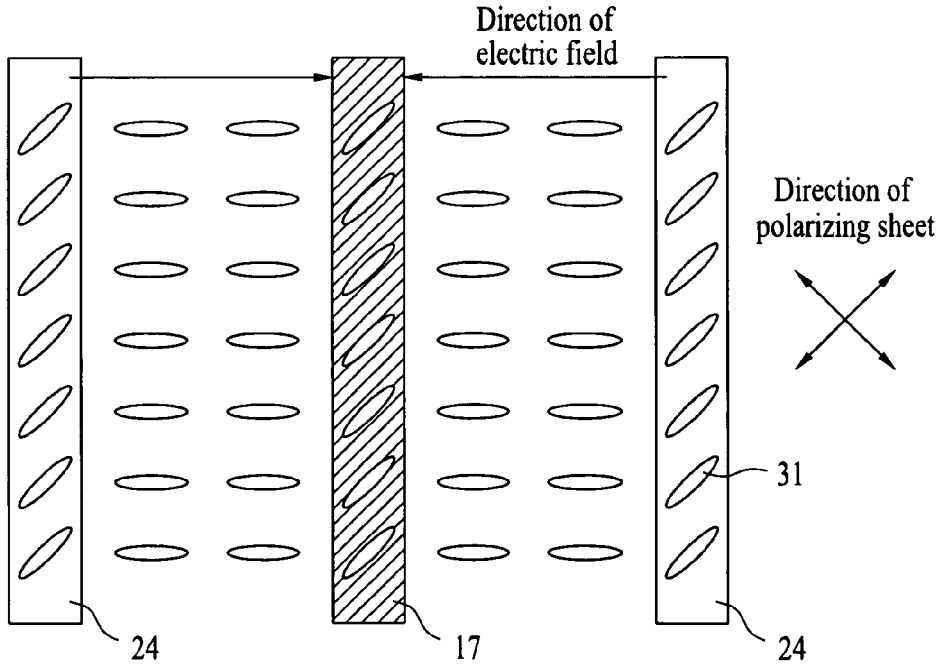
FIG. 4B Related Art
Figure 5:
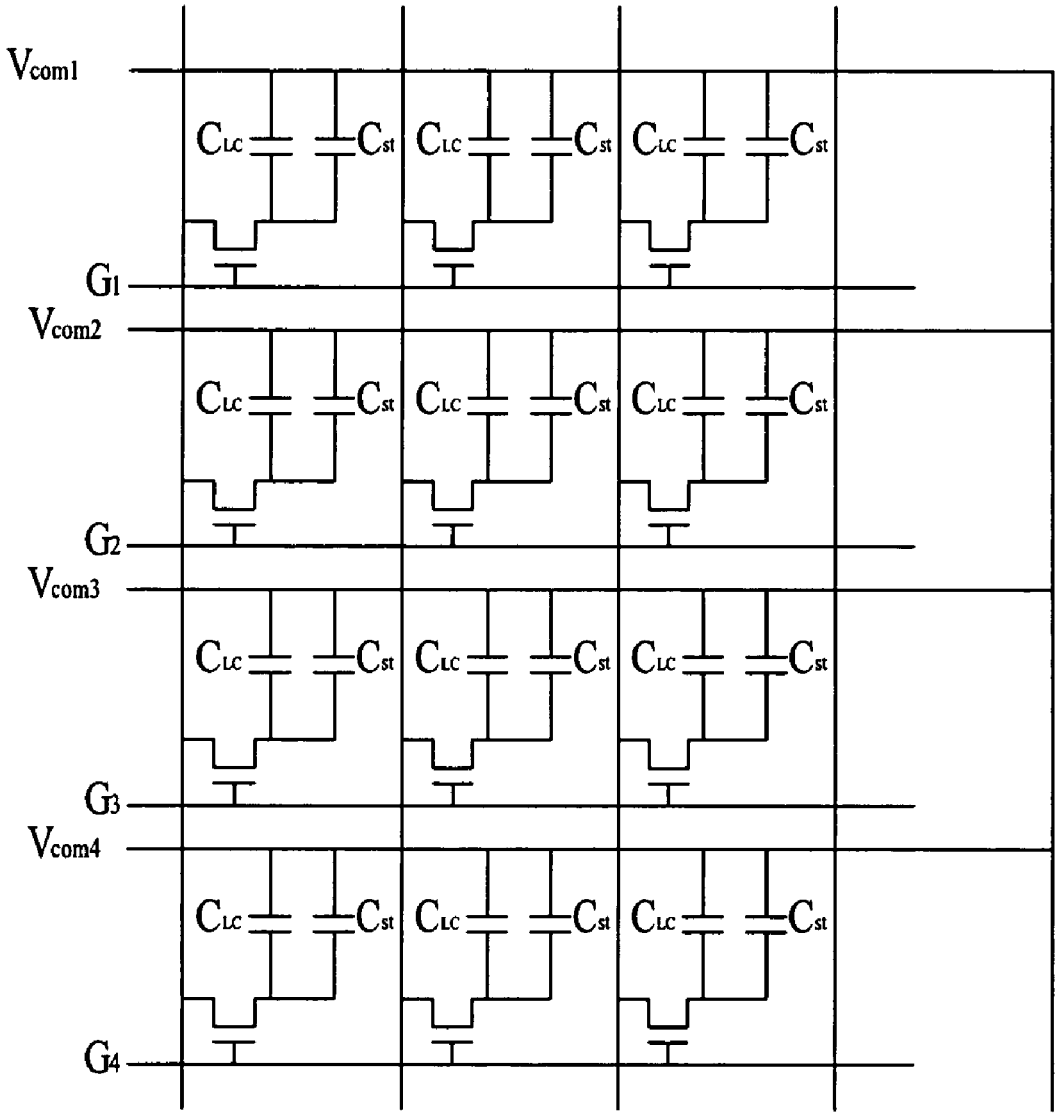
FIG. 5 Related Art
FIG. 5 illustrates an equivalent circuit view of an IPS mode LCD device according to the related art.
Figure 6:
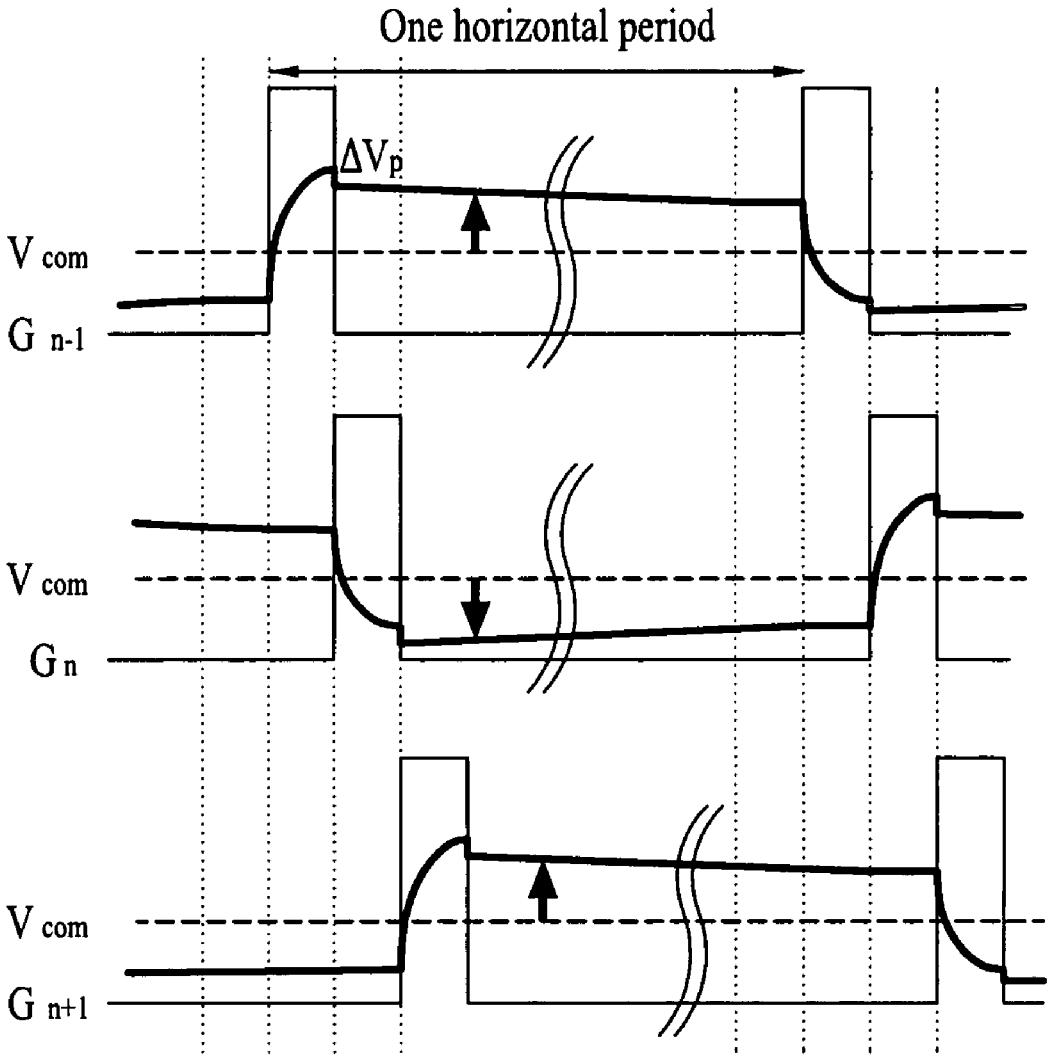
FIG. 6 Related Art
FIG. 6 illustrates a timing view of a pixel voltage in each gate line of FIG. 5.
Figure 7:
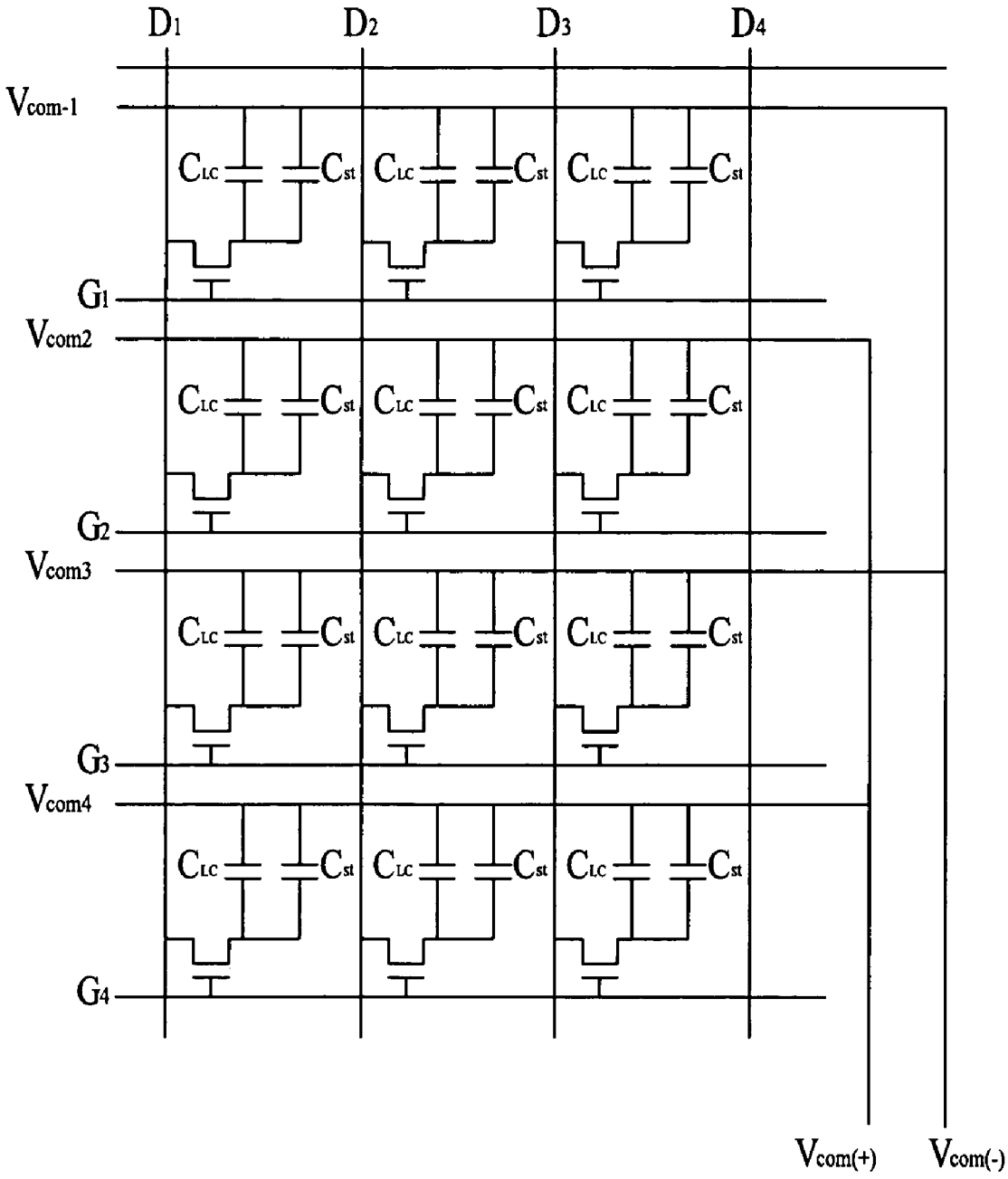
FIG. 7 Related Art
FIG. 7 illustrates an equivalent circuit view of a related art IPS mode LCD device for the increase of electrode interval and for the decrease of driving voltage.
Figure 8:
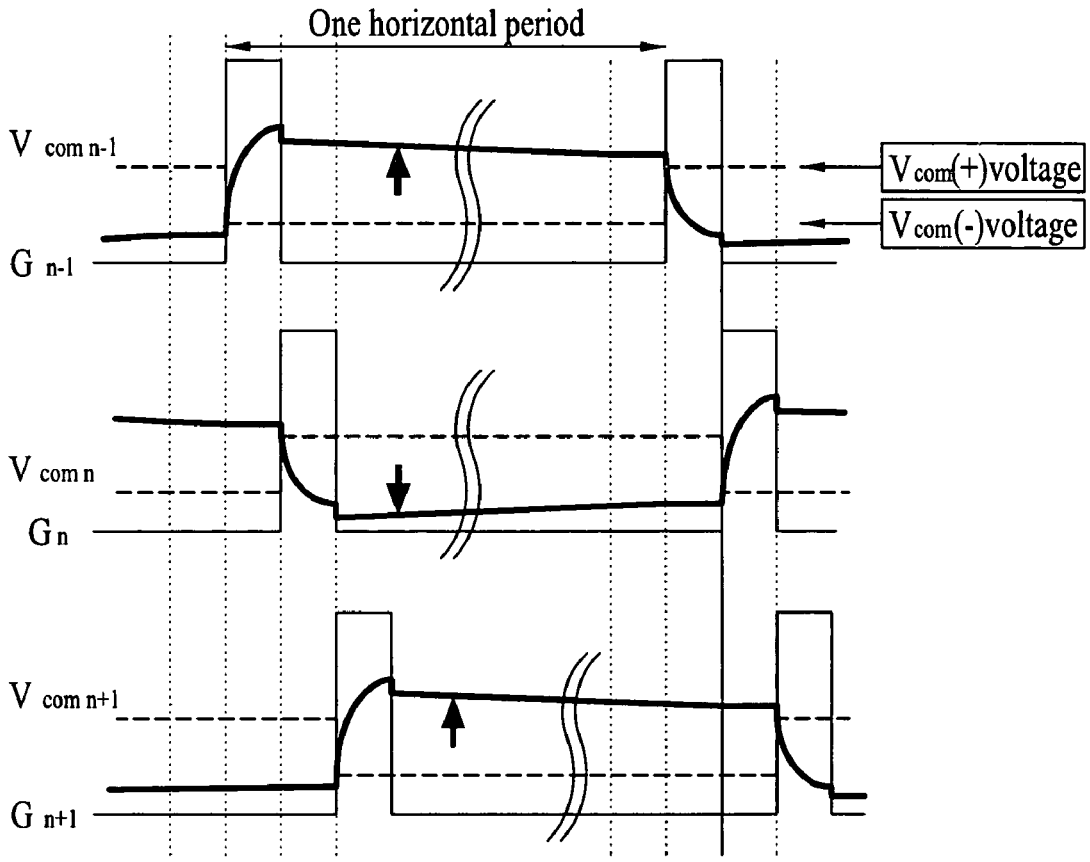
FIG. 8 Related Art
FIG. 8 illustrates a timing view of a pixel voltage in each gate line of FIG. 7.
Figure 9:
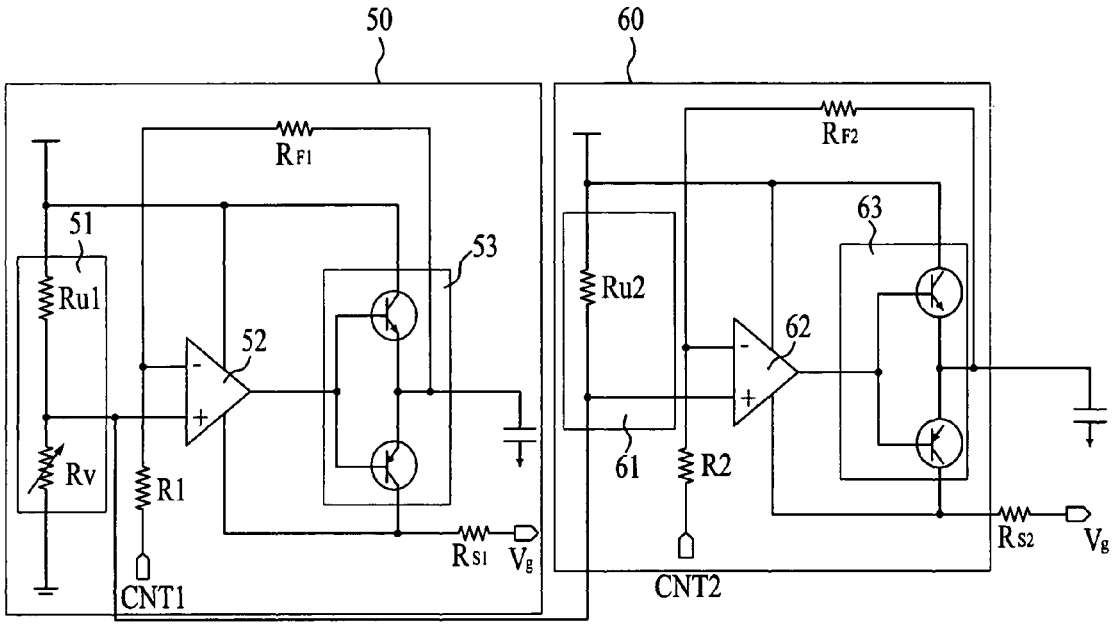
FIG. 9 Related Art
FIG. 9 illustrates a circuit diagram of a common voltage driving circuit by a common voltage swing method according to the related art.

The first and second common voltage output parts 150 and 160 respectively include first and second dividers 151 and 161, first and second inversion amplifiers 152 and 162, and first and second push/pull amplifiers 153 and 163. The first divider 151 provided with resistors Ru1 and Rv and the second divider 161 provided with resistor Ru2 divide the constant voltage $V_{LCD}$. Also, the first and second inversion amplifiers 152 and 162 amplify and output respective voltages output from the first and second dividers 151 and 161 according to first and second control signals CNT1 and CNT2 output from a timing controller ('3' of FIG. 1). Then, the first and second push/pull amplifiers 153 and 163 re-amplify the respective voltages output from the first and second inversion amplifiers 152 and 162 to signals having great linearization and less distortion, and output the re-amplified voltages to the odd numbered common lines and the even numbered common lines, respectively.

Figure 10:
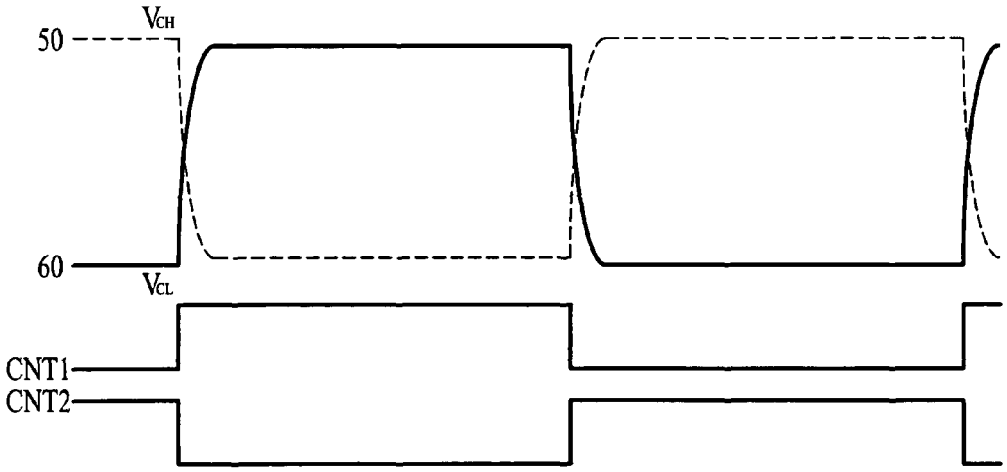
FIG. 10 Related Art
FIG. 10 illustrates a timing view of an output waveform of FIG. 9.

An operation of the common voltage driving circuit of the IPS mode LCD device according to the exemplary embodiment is described in detail in reference to FIG. 11. Similar to the illustration in FIG. 10, the first and second common voltage output parts 150 and 160 output the signals having the opposite phases according to the first and second control signals CNT1 and CNT2 output from the timing controller. Also, the first and second common voltage output parts 150 and 160 swing the common voltages to have the different polarities, by using the respective first and second inversion amplifiers 152 and 162 and the first and second push/pull amplifiers 153 and 163.

Referring to FIG. 12, each of the first and second switching parts 180 and 190 selects the voltage output from the intermediated level output part 170 at the transit timing of the first and second common voltages. At this time, the timing controller controls the switching operations of the first and second switching parts 180 and 190. The common voltage driving circuit of the IPS mode LCD device of the exemplary embodiment decreases the power consumption by using an energy accumulation device, such as an inductor or capacitor.

Figure 13:
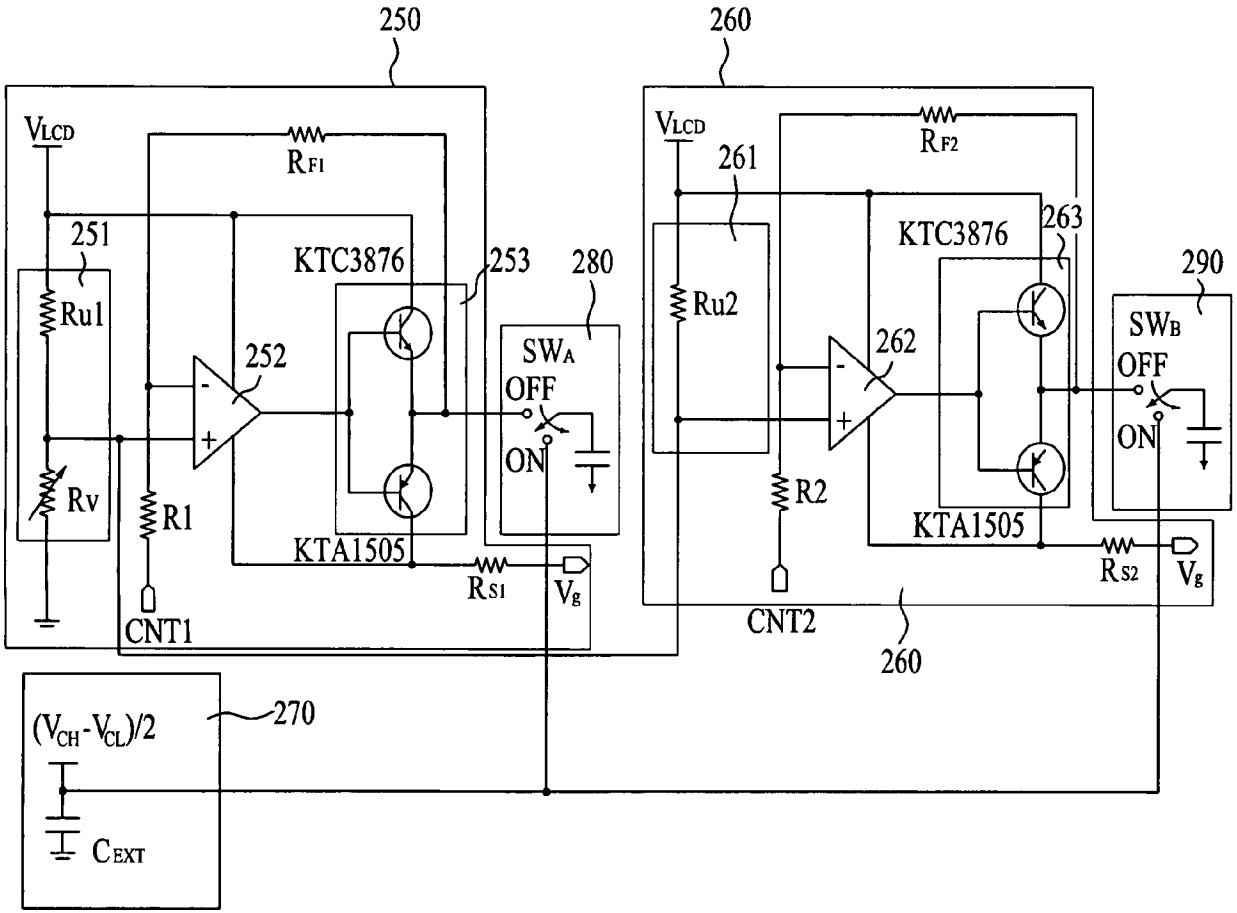
FIG. 13 illustrates a circuit diagram of a common voltage driving circuit of an IPS mode LCD device according to another embodiment of the present invention.
Figure 14:
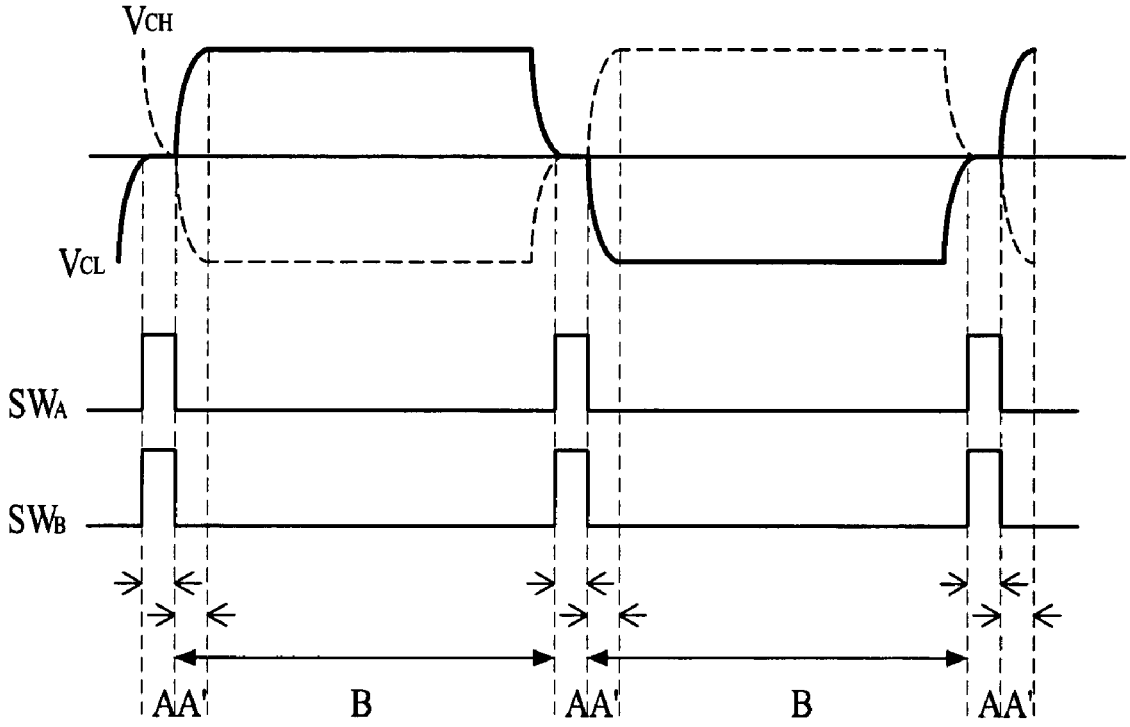
FIG. 14 illustrates a timing view of an output waveform of FIG. 13.

FIG. 13 illustrates a circuit diagram of a common voltage driving circuit of an IPS mode LCD device according to another exemplary embodiment of the present invention. FIG. 14 illustrates a timing view of an output waveform of FIG. 13. As shown in FIG. 13, a common voltage driving circuit of an IPS mode LCD device according to this exemplary embodiment includes a first common voltage output part 250, a second common voltage output part 260, an intermediate level output part 270, a first switching part 280, and a second switching part 290. At this time, the first common voltage output part 250 swings and outputs positive (+) and negative (−) common voltages on odd numbered common lines. The second common voltage output part 260 swings and outputs negative (−) and positive (+) common voltages on even numbered common lines. The intermediate level output part 270 having an energy accumulation device ($C_{EXT}$) stores and outputs a voltage of an intermediate level between the positive (+) and negative (−) common voltages output from the first and second common voltage output parts 250 and 260. The first switching part 280 selects one out of the voltages output from the first common voltage output part 250 and the intermediate level output part 270, and then outputs the selected one. The second switching part 290 selects one out of the voltages output from the second common voltage output part 260 and the intermediate level output part 270, and then outputs the selected one.

The first and second common voltage output parts 250 and 260 respectively include first and second dividers 251 and 261, first and second inversion amplifiers 252 and 262, and first and second push/pull amplifiers 253 and 263. The first divider 251 provided with resistors Ru1 and Rv and the second divider 261 provided with a resistor Ru2 divide a constant voltage $V_{LCD}$. Also, the first and second inversion amplifiers 252 and 262 amplify and output respective voltages output from the first and second dividers 251 and 261 according to first and second control signals CNT1 and CNT2 output from a timing controller ('3' of FIG. 1). Then, the first and second push/pull amplifiers 253 and 263 re-amplify the respective voltages output from the first and second inversion amplifiers 252 and 262 to signals having great linearization and less distortion, and output the re-amplified voltages to the odd numbered common lines and the even numbered common lines, respectively.

Next, an operation of the common voltage driving circuit of the IPS mode LCD device according to this exemplary embodiment is described in reference to FIG. 13. As shown in FIG. 13, the first and second common voltage output parts 250 and 260 output the signals having the opposite phases, according to the first and second control signals CNT1 and CNT2 output from the timing controller. The first and second common voltage output parts 250 and 260 swing the common voltages to have the different polarities, by using the respective first and second inversion amplifiers 252 and 262 and the first and second push/pull amplifiers 253 and 263.

Referring to FIG. 14, each of the first and second switching parts 280 and 290 selects the voltage output from the intermediated level output part 270 at the transit timing of the first and second common voltages. At this time, the energy accumulation device ($C_{EXT}$) of the intermediate level output part 270 discharges electric charges accumulated during a section "A" of FIG. 14, and charges electric charges during a section "A'" of FIG. 14. When the common voltage in this method is swung, it is possible to decrease the power consumption by using the voltage charged by the energy accumulation device ($C_{EXT}$). That is, by using the energy accumulation device ($C_{EXT}$), the power consumption ($P_{AC}$) is shown as following equation.

$$P_{AC}=n\times C\times f\times((V_{CH}-V_{CL})/2)^2$$

In the common voltage driving circuit according to the exemplary embodiment, even though values of 'n', 'C', and 'f' are same as those of the related art, it is possible to decrease the power consumption to approx. ¼ as compared with the related art, since the swing width of the common voltage decreases by half.

As mentioned above, the common voltage driving circuit of the IPS mode LCD device according to the preferred embodiments of the present invention have the following advantages. First, the first and second switching parts are respectively provided on the output terminals of the first and second common voltage output parts for outputting the common voltages to the odd numbered common lines and the even numbered common lines, and the intermediate level output part is provided to output the voltage of the intermediate level between the positive (+) and negative (−) common voltages, whereby the voltage output from the intermediate level output part is applied to the common line at the transit timing of the common voltage. As a result, it is possible to decrease the power consumption by decreasing the swing width of the common voltage by half. In addition, the voltage is charged when the positive (+) or negative (−) common voltage is output by using the energy accumulation device of the intermediate level output part, and the voltage is discharged at the transit point of the common voltage, so that the intermediate level voltage is output, thereby decreasing the power consumption further.

It will be apparent to those skilled in the art that various modifications and variations can be made in the circuit for driving common voltage in IPS mode LCD display device of the present invention without departing from the spirit or scope of the invention. Thus, it is intended that the present invention cover the modifications and variations of this invention provided they come within the scope of the appended claims and their equivalents.

What is claimed is:

1. A common voltage driving circuit of an in-plane switching mode liquid crystal display device comprising:

a first common voltage output part for swinging and outputting positive (+) and negative (−) common voltages on odd numbered common lines;

a second common voltage output part for swinging and outputting negative (−) and positive (+) common voltages on even numbered common lines;

an intermediate level output part for outputting an intermediate level voltage between the positive (+) and negative (−) common voltages output from the first and second common voltage output parts;

a first switching part for selecting one out of the voltages output from the first common voltage output part and the intermediate level output part, and then outputting the selected one; and a second switching part for selecting one out of the voltages output from the second common voltage output part and the intermediate level output part, and then outputting the selected one, wherein the voltage output from the intermediate level output part is applied to the common line on the transit timing of the first voltage or on the transit timing of the second voltage, wherein the switching operations of the first and second switching parts is controlled by a timing controller, wherein the first common voltage output part includes a divider for dividing the constant voltage, a first amplifier for amplifying the voltage output from the divider according to an external control signal, and outputting a first amplified voltage, and a second amplifier for amplifying the first amplified voltage to generate a signal having great linearization and less distortion, and outputting a second amplified voltage, wherein the second common voltage output part includes a divider for dividing the constant voltage, a first amplifier for amplifying the voltage output from the divider according to an external control signal, and outputting a first amplified voltage, and a second amplifier for amplifying the first amplified voltage to generate a signal having great linearization and less distortion, and outputting a second amplified voltage, wherein the intermediate level output part divides a constant voltage to output the divided the constant voltage, or the intermediate level part stores the intermediate level voltage using an energy accumulation device to output the intermediate level voltage stored in the energy accumulation device, wherein the first amplifier is an inversion amplifier and the second amplifier is a push/pull amplifier, wherein first and second common voltage output parts swing the common voltages to have the different polarities, by using the inversion amplifiers and the push/pull amplifiers, wherein the energy accumulation device discharges electric charges accumulated during a first predetermined period and charges electric charges during a second predetermined period, wherein the first predetermined period is equal to the second predetermined period, wherein an A.C. power consumption ($P_{AC}$) is obtained by the following equation:

$$P_{AC}=n\times C\times f\times((V_{CH}-V_{CL})/2)^2$$

wherein "n" denotes the number of common voltages swung, "C" denotes a capacitor load of the common voltage, "f" denotes a frequency of the common voltage and ($V_{CH}-V_{CL}$) is a swing width between the positive (+) and negative (−) common voltages.

2. A method for driving a common voltage in an IPS mode LCD device comprising:

swinging and outputting positive (+) and negative (−) common voltages on odd numbered common lines;

swinging and outputting negative (−) and positive (+) common voltages on even numbered common lines;

outputting an intermediate level voltage between the positive (+) and negative (−) common voltages output from the first and second common voltage output parts;

selecting one out of the voltage output to the odd numbered common lines and the intermediate level voltage, and then outputting the selected one; and selecting one out of the voltage output to the even numbered common lines and the intermediate level voltage, and then outputting the selected one, wherein the voltage output from the intermediate level output is applied to the common line on the transit timing of the first voltage or on the transit timing of the second voltage, wherein the selecting one out of the intermediate level voltage, the first voltage or the second voltage is controlled by a timing controller, wherein swinging and outputting positive (+) and negative (−) common voltages on the odd numbered common lines includes dividing the constant voltage by means of a divider, amplifying the voltage output from the divider according to an external control signal by means of a first amplifier, and outputting a first amplified voltage; and amplifying the first amplified voltage by means of a second amplifier to generate a signal having great linearization and less distortion, and outputting a second amplified voltage, wherein swinging and outputting negative (−) and positive (+) common voltages on the even numbered common lines includes dividing the constant voltage by means of a divider, amplifying the voltage output from the divider according to an external control signal by means of a first amplifier, and outputting a first amplified voltage; and amplifying the first voltage by means of a second amplifier to generate a signal having great linearization and less distortion, and outputting a second amplified voltage, wherein outputting the intermediate level voltage includes dividing a constant voltage to output the divided constant voltage, or storing the intermediate level using an energy accumulation device to output the intermediate level voltage stored in the energy accumulation device, wherein the first amplifier is an inversion amplifier and the second amplifier is a push/pull amplifier, and wherein the first and second common voltage output parts swing the common voltages to have the different polarities, by using the inversion amplifiers and the push/pull amplifiers, wherein the energy accumulation device discharges electric charges accumulated during a first predetermined period and charges electric charges during a second predetermined period, wherein the first predetermined period is equal to the second predetermined period, wherein an A.C. power consumption ($P_{AC}$) is obtained by the following equation:

$$P_{AC}=n\times C\times f\times((V_{CH}-V_{CL})2)^2$$

wherein "n" denotes the number of common voltages swung, "C" denotes a capacitor load of the common voltage, "f" denotes a frequency of the common voltage and ($V_{CH}-V_{CL}$) is a swing width between the positive (+) and negative (−) common voltages.

* * * * *